US011763790B2

(12) United States Patent
You et al.

(10) Patent No.: US 11,763,790 B2
(45) Date of Patent: Sep. 19, 2023

(54) ACTIVE NOISE CONTROL APPARATUS FOR VEHICLES AND METHOD OF CONTROLLING THE SAME

(71) Applicants: Hyundai Motor Company, Seoul (KR); Kia Corporation, Seoul (KR)

(72) Inventors: Jung Keun You, Suwon-si (KR); Kaang Dok Yee, Yongin-si (KR); Myoung Ok Lee, Seoul (KR); Mun Hwan Cho, Seoul (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 0 days.

(21) Appl. No.: 17/542,031

(22) Filed: Dec. 3, 2021

(65) Prior Publication Data

US 2022/0199065 A1 Jun. 23, 2022

(30) Foreign Application Priority Data

Dec. 23, 2020 (KR) ..... 10-2020-0182405

(51) Int. Cl.
*G10K 11/178* (2006.01)

(52) U.S. Cl.
CPC .. *G10K 11/17815* (2018.01); *G10K 11/17823* (2018.01); *G10K 11/17825* (2018.01); *G10K 11/17853* (2018.01); *G10K 11/17881* (2018.01); *G10K 2210/1282* (2013.01); *G10K 2210/3023* (2013.01); *G10K 2210/3028* (2013.01); *G10K 2210/3044* (2013.01); *G10K 2210/3047* (2013.01)

(58) Field of Classification Search
CPC ..... G10K 11/17815; G10K 11/17823; G10K 11/17853; G10K 11/17825; G10K 11/17881; G10K 2210/1282; G10K 2210/3023; G10K 2210/3028; G10K 2210/3044; G10K 2210/3047
USPC ..... 381/71.6
See application file for complete search history.

(56) References Cited

U.S. PATENT DOCUMENTS

2019/0228757 A1* 7/2019 Chwioko ..... G10K 11/1754
2020/0388266 A1 12/2020 You et al.

FOREIGN PATENT DOCUMENTS

KR 10-2020-0141253 A 12/2020
KR 10-2021-0096879 A 8/2021

* cited by examiner

*Primary Examiner* — Vivian C Chin
*Assistant Examiner* — Douglas J Suthers
(74) *Attorney, Agent, or Firm* — MORGAN, LEWIS & BOCKIUS LLP

(57) ABSTRACT

An active noise control apparatus of vehicles capable of making it difficult for a passenger in a vehicle to hear the voice of another passenger, achieving privacy protection, and a method of controlling the same are disclosed. The active noise control method includes primarily determining a noise level based on a first microphone signal input through a microphone corresponding to a first seat, secondarily determining whether to output an anti-noise signal generated based on the first microphone signal and the magnitude of the anti-noise signal based on the noise level and the level of the first microphone signal, and outputting the anti-noise signal through a headrest speaker of a second seat in response to the secondary determining.

17 Claims, 8 Drawing Sheets

ACTIVE NOISE CONTROL APPARATUS FOR VEHICLES AND METHOD OF CONTROLLING THE SAME

CROSS-REFERENCE TO RELATED APPLICATION

The present application claims priority to Korean Patent Application No. 10-2020-0182405, filed on Dec. 23, 2020, the entire contents of which is incorporated herein for all purposes by this reference.

BACKGROUND OF THE INVENTION

Field of the Invention

The present invention relates to an active noise control apparatus of vehicles capable of making it difficult for a passenger in a vehicle to hear the voice of another passenger, achieving privacy protection, and a method of controlling the same.

Description of Related Art

To date, vehicle manufacturers have made great efforts to reduce in-vehicle noise. As part of such efforts, an active noise control system that generates a sound having an opposite phase to noise to overlap the noise to reduce the noise has been introduced in addition to a passive noise control system, such as addition or improvement of a sound insulator or a vibration damper.

In recent years, a method of not only controlling noise introduced from outside a vehicle, such as road noise, but also blocking noise between passengers using such an active noise control system has been provided. This will be described with reference to FIG. 1.

FIG. 1 shows an example of an active noise control configuration for vehicles using anti-noise.

In FIG. 1, it is assumed that, in a situation in which a driver and a back seat passenger are accommodated in a chauffeur-driven vehicle, the back seat passenger makes a telephone call. In the instant case, the back seat passenger generally does not want the driver to hear their own telephone conversation for privacy protection.

To the present end, voice of the passenger may be input to a microphone disposed at a back seat, the magnitude of a voice signal may be analyzed for each frequency band to generate a sound having an opposite phase necessary to offset the voice (i.e., anti-noise), and the anti-noise may be output through a speaker mounted at a headrest of a driver's seat. As a result, the voice of the passenger and the anti-noise may overlap each other, whereby the voice of the passenger and the anti-noise may be offset, making it difficult for the driver to recognize the telephone conversation of the passenger.

In the above method, however, when the back seat passenger does not speak but air conditioning noise, road surface noise, or nearby noise due to opening of a window are input to the microphone, the anti-noise may be output, whereby aural fatigue of the driver may be caused.

The information disclosed in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing an active noise control apparatus of vehicles and a method of controlling the same that substantially obviate one or more problems due to limitations and disadvantages of the related art.

Various aspects of the present invention are directed to providing an active noise control apparatus of vehicles configured for more effectively making it difficult for a driver to hear the voice of a passenger and a method of controlling the same.

Various aspects of the present invention are directed to providing an active noise control apparatus of vehicles configured for controlling anti-noise in consideration of the magnitude of nearby noise and a method of controlling the same.

Objects of the present invention devised to solve the problems are not limited to the aforementioned object, and other unmentioned objects will be clearly understood by those skilled in the art based on the following detailed description of the present invention.

To achieve these objects and other advantages and in accordance with the purpose of the present invention, as embodied and broadly described herein, an active noise control method for vehicles may include primarily determining a noise level based on a first microphone signal input through a microphone corresponding to a first seat, secondarily determining whether to output an anti-noise signal generated based on the first microphone signal and the magnitude of the anti-noise signal based on the noise level and the level of the first microphone signal, and outputting the anti-noise signal through a headrest speaker of a second seat in response to the secondary determining.

In another aspect of the present invention, an active noise control apparatus of vehicles may include a microphone corresponding to a first seat, an active noise control unit configured to generate an anti-noise signal based on a first microphone signal input through the microphone, and a headrest speaker disposed at a second seat, the headrest speaker being configured to output noise corresponding to the anti-noise signal, wherein the active noise control unit may determine a noise level based on the first microphone signal and determines whether to output the anti-noise signal generated and the magnitude of the anti-noise signal based on the noise level and the level of the first microphone signal.

It is to be understood that both the foregoing general description and the following detailed description of the present invention are exemplary and explanatory and are intended to provide further explanation of the present invention as claimed.

The methods and apparatuses of the present invention have other features and advantages which will be apparent from or are set forth in more detail in the accompanying drawings, which are incorporated herein, and the following Detailed Description, which together serve to explain certain principles of the present invention.

BRIEF DESCRIPTION OF THE DRAWINGS

The accompanying drawings, which are included to provide a further understanding of the present invention and are incorporated in and form a part of the present application, illustrate embodiment(s) of the present invention and together with the description serve to explain the principle of the present invention. In the drawings.

Figure 1:
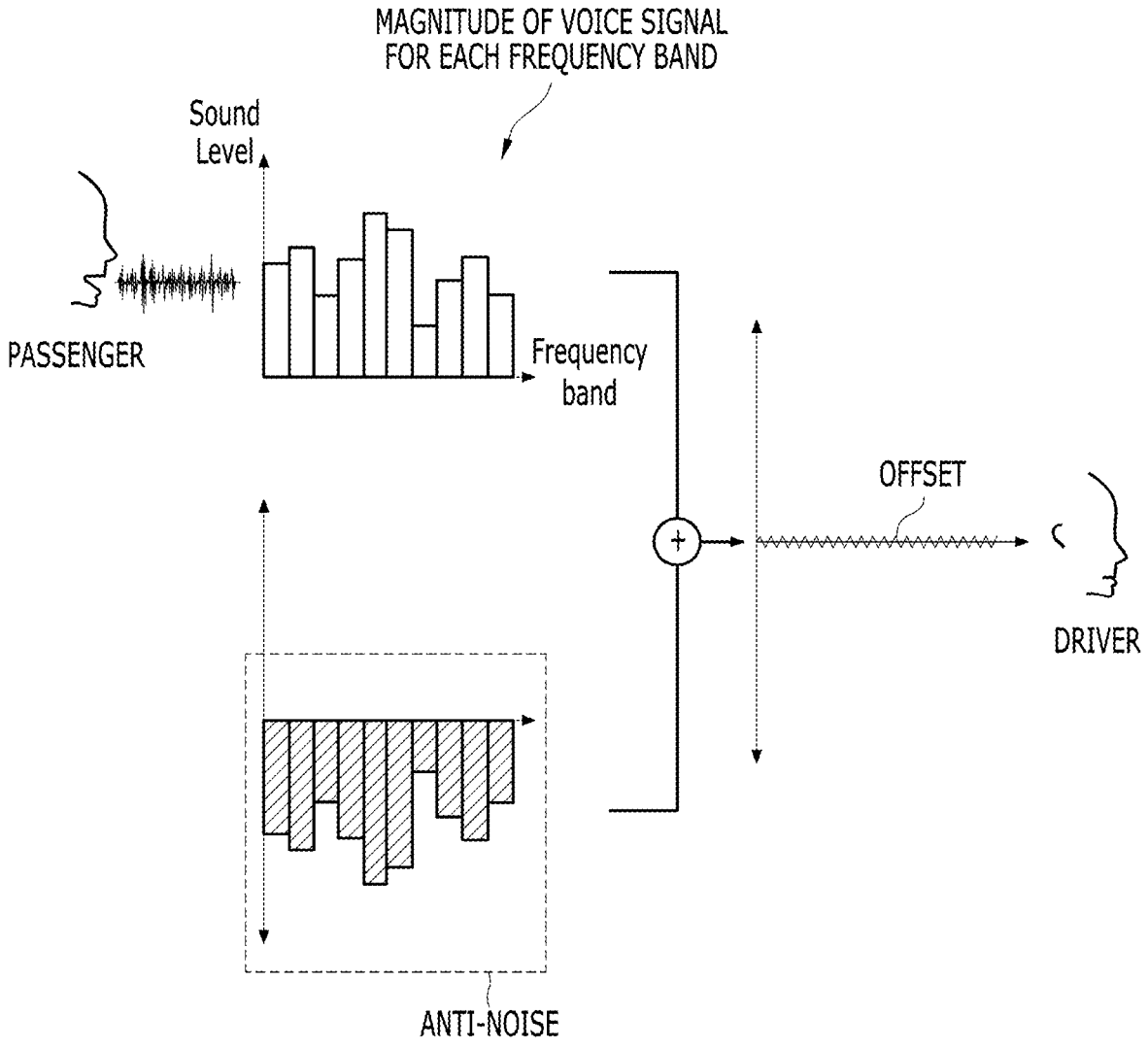
FIG. 1 shows an example of an active noise control configuration for vehicles using anti-noise.

It may be understood that the appended drawings are not necessarily to scale, presenting a somewhat simplified representation of various features illustrative of the basic principles of the present invention. The specific design features of the present invention as disclosed herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to the exemplary embodiments of the present invention, examples of which are illustrated in the accompanying drawings. The following embodiments are given by way of example in order to enable those skilled in the art to fully understand the idea of the present invention. Therefore, the present invention is not limited by the following embodiments, and may be realized in various other forms. In order to clearly describe the present invention, parts having no relation with the description of the present invention have been omitted from the drawings. Wherever possible, the same reference numerals will be used throughout the specification to refer to the same or like parts.

The term "comprises" or "includes" used herein should be interpreted not to exclude other elements but to further include such other elements, unless mentioned otherwise. Furthermore, the same reference numerals denote the same constituent elements throughout the specification.

In the following description, it is assumed that a passenger who speaks is a back seat passenger and a passenger who hears anti-noise configured to disturb recognition of speech is a driver in a driver's seat.

Figure 2:
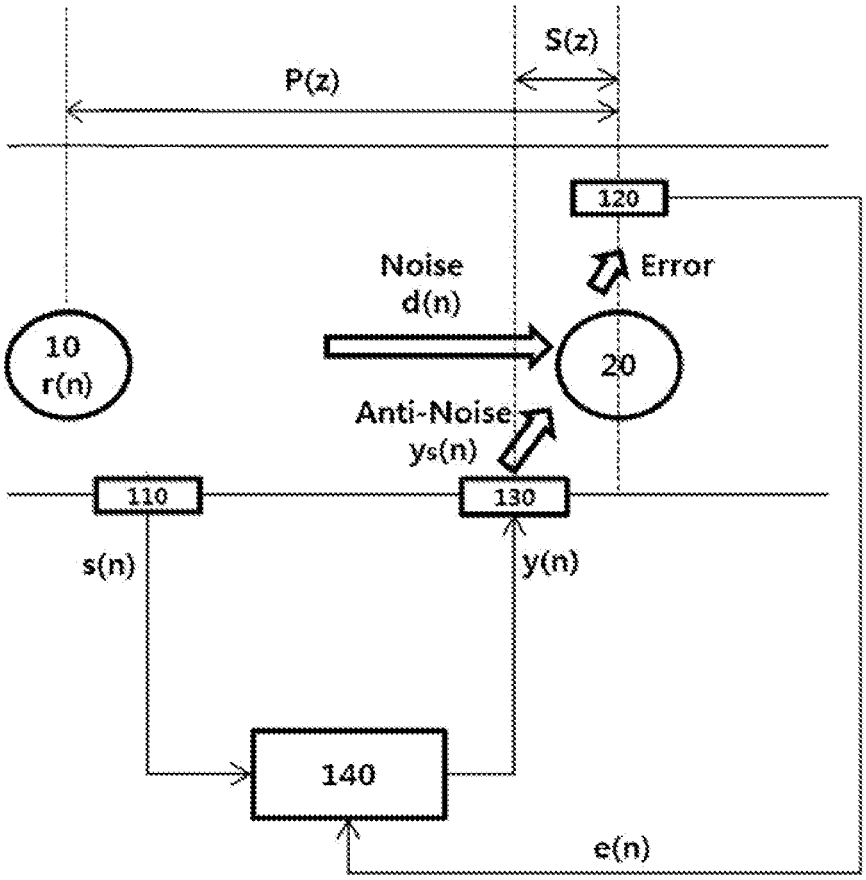
FIG. 2 is a view exemplarily illustrating the concept of an active noise control apparatus according to various exemplary embodiments of the present invention.

FIG. 2 is a view exemplarily illustrating the concept of an active noise control apparatus according to various exemplary embodiments of the present invention.

Referring to FIG. 2, when a back seat passenger 10 speaks, spoken voice r(n) is input to a reference microphone 110 while propagating to the interior of a vehicle. The reference microphone 110 may be disposed at a position at which the spoken voice of the back seat speaker is appropriately input to the reference microphone, e.g., a back seat roof; however, the present invention is not limited thereto.

The spoken voice input to the reference microphone 110 is converted into a microphone signal s(n), which is input to an active noise control unit 140. The control unit 140 generates an anti-noise signal y(n) using the microphone signal s(n), and transmits the same to a speaker 130. It is preferable for the speaker 130 to be a speaker 130 disposed at a headrest of a driver's seat. An audio amplifier may be disposed between the control unit 140 and the speaker 130. The characteristics of an acoustic path between the speaker 130 and a specific position of the driver's seat (i.e., a position corresponding to ears of a driver) (i.e., a secondary path S(z)) are reflected in the anti-noise signal y(n), whereby anti-noise $y_s(n)$ is transmitted to the ears of the driver through the speaker 130.

During transmission of the anti-noise $y_s(n)$, the characteristics of an acoustic path from the back seat to the driver's seat (i.e., a primary path P(z)) are reflected in the spoken voice r(n), which propagates to the interior of the vehicle, whereby noise d(n) is transmitted to the driver.

As a result, the driver hears a combination of the noise d(n) and the anti-noise $y_s(n)$, i.e., overlapping noise, whereby it is difficult to recognize the noise d(n).

Reverberation left after the noise d(n) and the anti-noise $y_s(n)$ are offset due to overlapping, i.e., an error, is input to an error microphone 120, whereby an error microphone signal e(n) is fed back to the control unit 140. The control unit 140 may detect a control error from the microphone signal and may adaptively select a filter configured to output an anti-noise signal in a direction in which the control error is minimized. Here, the control error may be detected using a method of determining a transfer function $\hat{S}(z)$ including characteristics of all transfer paths until the anti-noise signal is input to the error microphone 120 via the speaker 130 after the control unit 140 outputs the anti-noise signal, applying the transfer function to the microphone signal s(n), and comparing the same with the error microphone signal e(n) (e.g., least mean squares (LMS) algorithm).

Elements considered in characteristics of the transfer path may include at least one of a DAC, a reconstruction filter, the audio amplifier, the speaker 130, an acoustic path from the speaker 130 to the error microphone 120, a microphone preamplifier, an anti-aliasing filter, and an ADC; however, the present invention is not limited thereto. Furthermore, it is preferable for the transfer function to be provided in advance through calculation, experimental verification, and tuning.

The active noise control apparatus may allow the passenger to determine whether to output the anti-noise using a separator switch; however, the present invention is not limited thereto. Furthermore, when the active noise control apparatus is enabled, it is preferable for a hands-free function of a passenger's mobile terminal to be disabled.

In the active noise control apparatus described with reference to FIG. 2, however, anti-noise may be output due to nearby noise even in a period in which the passenger does not speak. The present situation will be described with reference to FIG. 3.

Figure 3:
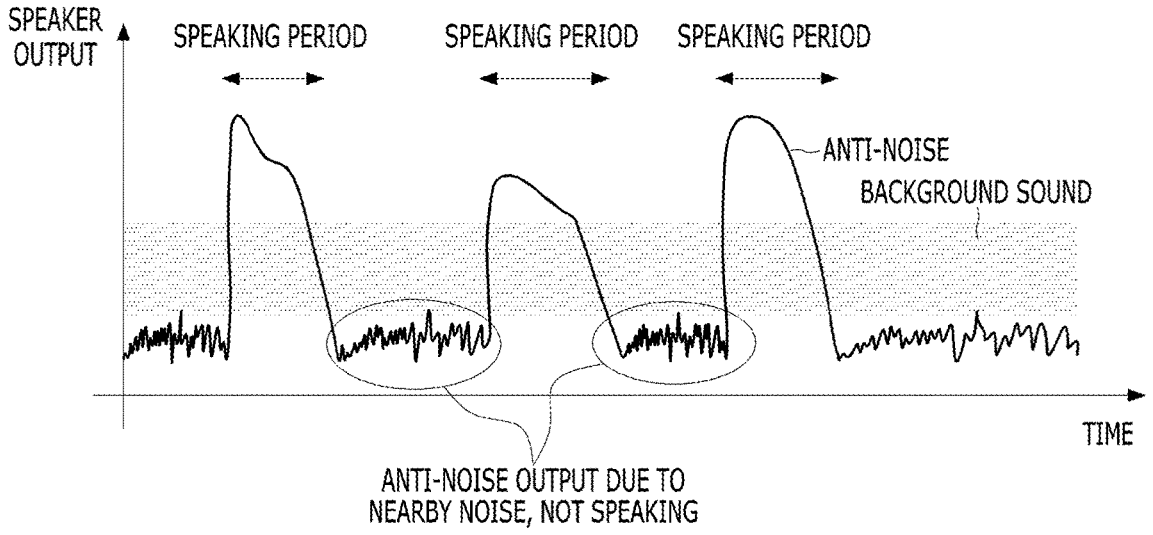
FIG. 3 shows an example of a configuration in which anti-noise is output by nearby noise, rather than speaking.

FIG. 3 shows an example of a configuration in which anti-noise is output by nearby noise, rather than speaking.

Referring to FIG. 3, when the function of the active noise control unit is enabled, predetermined background sound (e.g., sound of nature, such as sound of running water or birdsong) is continuously played, and anti-noise may be output in response to the microphone signal. In a period other than a speaking period in which the passenger speaks, however, anti-noise may be continuously output as a result of introduction of road surface noise, air conditioning noise, or external noise due to opening of a window.

To solve the present problem, embodiments of the present invention are directed to providing a method of determining a noise level based on nearby noise in controlling active noise control for protecting privacy of the passenger who speaks in the vehicle, outputting anti-noise when the microphone signal is greater than the noise level, and preventing output of anti-noise in a non-speaking period. Furthermore, various aspects of the present invention are directed to providing a method of reducing the magnitude of anti-noise by the noise level to reduce aural burden of another passenger due to the anti-noise.

A control concept according to exemplary embodiments will be described with reference to FIG. 4.

Figure 4:
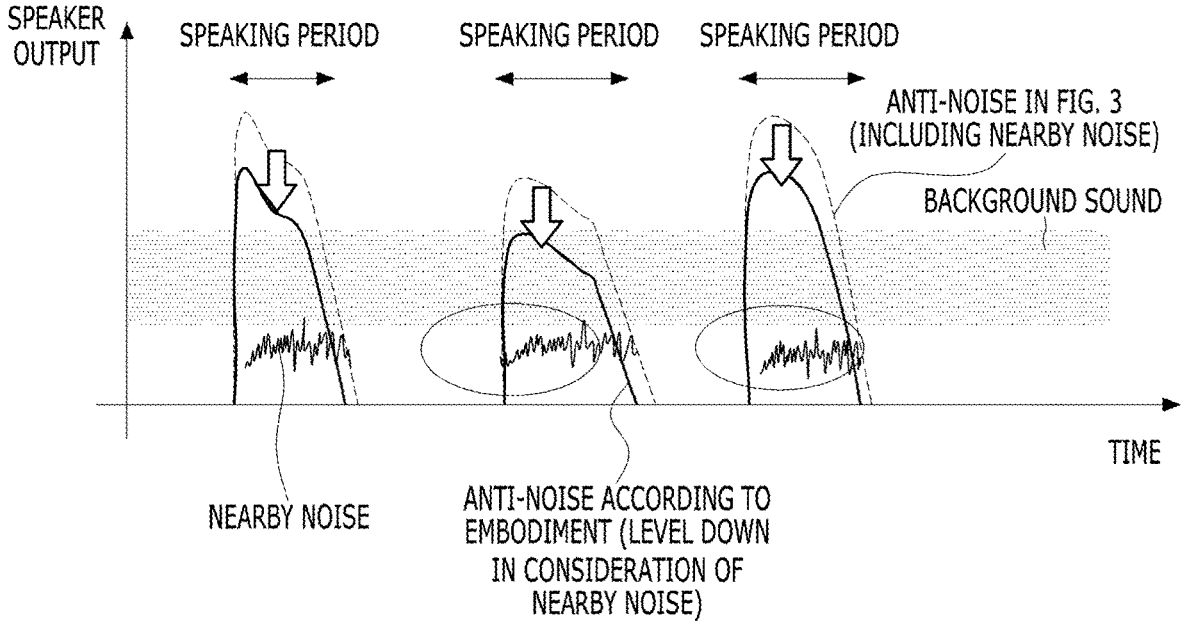
FIG. 4 shows an example of a configuration in which anti-noise considering nearby noise according to an exemplary embodiment of the present invention is output.

FIG. 4 shows an example of a configuration in which anti-noise considering nearby noise according to an exemplary embodiment of the present invention is output.

Referring to FIG. 4, background sound is output in the same manner as in FIG. 3, and anti-noise may be output only in a speaking period in which the level of the microphone signal is higher than a noise level considering nearby noise. In FIG. 3, the magnitude of the anti-noise is determined based on the microphone signal including even nearby noise. In the exemplary embodiment of the present invention, however, the magnitude of the anti-noise is reduced by a noise level considering nearby noise, whereby aural discomfort of the driver may be reduced.

Figure 5:
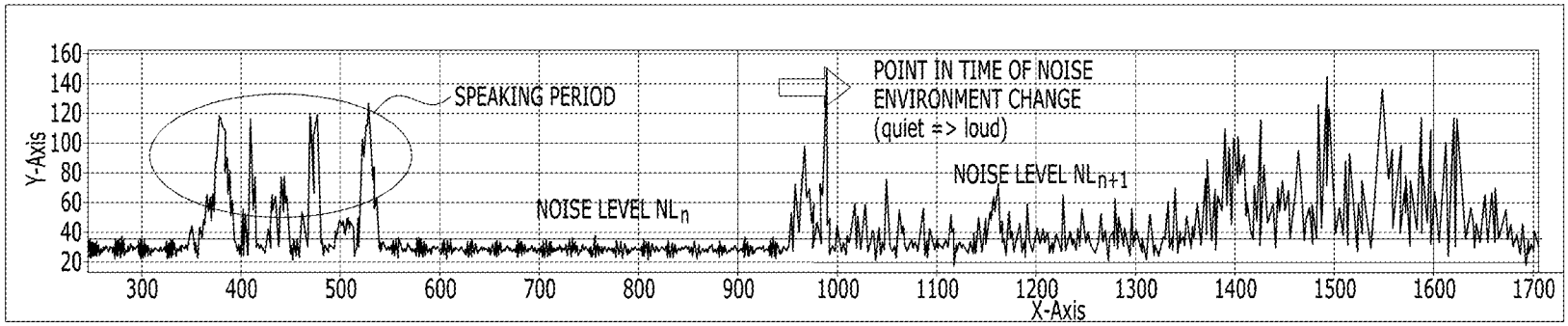
FIG. 5 shows an example of a noise level change configuration.

FIG. 5 shows an example of a noise level change configuration.

In the graph of FIG. 5, the horizontal axis indicates time, and the vertical axis indicates level (magnitude) of the microphone signal.

Referring to FIG. 5, in the first half, a noise level $NL_n$ is uniformly maintained excluding speaking periods, but the noise level increases ($NL_{n+1}$) from the point in time at which noise environment is changed. For example, the present situation may be a situation in which nearby noise outside the vehicle is introduced into the vehicle as a result of opening of the window at the point in time at which a noise environment is changed while driving in the state in which the window is closed. In the state in which the noise level increases, as described above, privacy protection is sufficiently achieved even though the output level of the anti-noise is reduced by the increased noise level.

Since the noise level is changed depending on situation, as described above, a method of appropriately determining the noise level is required, and the construction of an active noise control apparatus of the same will be described with reference to FIGS. 6 to 8.

Figure 6:
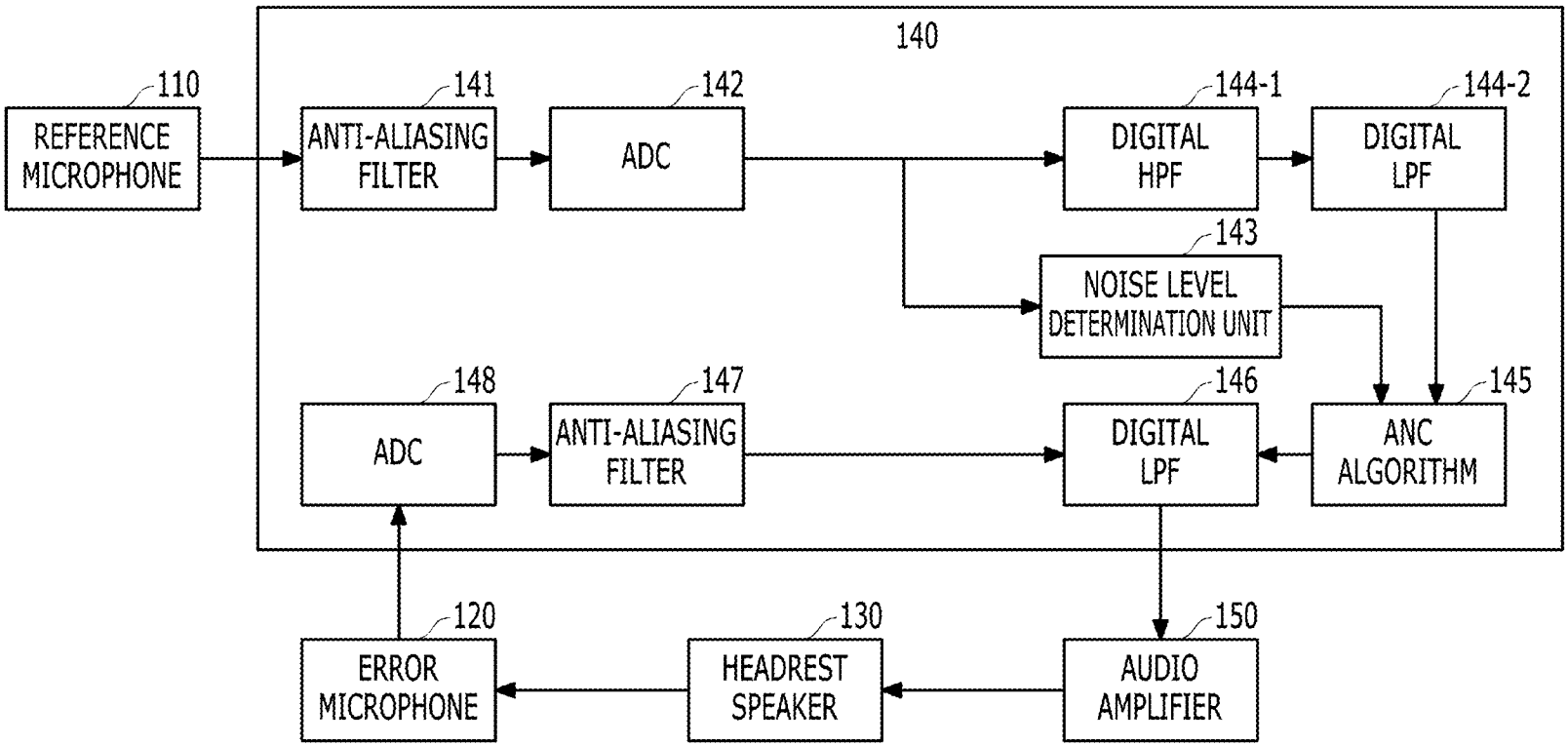
FIG. 6 shows an example of the construction of an active noise control apparatus according to various exemplary embodiments of the present invention.

FIG. 6 shows an example of the construction of an active noise control apparatus according to various exemplary embodiments of the present invention.

Referring to FIG. 6, the active noise control apparatus may include a reference microphone 110, an error microphone 120, a speaker 130, an active noise control unit 140, and an audio amplifier 150.

A microphone signal input to the reference microphone 110 may be converted into a digital signal through pre-processing, i.e., by an ADC 142 after passing through an anti-aliasing filter 141 of the active noise control unit 140.

The pre-processed microphone signal passes through a digital high-pass filter (HPF) 144-1 and a digital low-pass filter (LPF) 144-2, whereby only the voice band of a person may be extracted.

Furthermore, the pre-processed microphone signal may be input to a noise level determination unit 143, and the noise level determination unit 143 may determine a noise level based on nearby noise. Operation of the noise level determination unit 143 will be described in more detail with reference to FIG. 7.

An active noise control (ANC) algorithm 145 may generate an anti-noise signal y(n) according to a signal corresponding to the voice band, and may determine whether to output the anti-noise signal y(n) and the magnitude of the anti-noise signal y(n) based on the noise level determined by the noise level determination unit 143.

The anti-noise signal y(n) may be output through the speaker 130 via a digital LPF 146 and the audio amplifier 150. An error signal e(n) collected through the error microphone 120 may be converted into a digital signal through microphone pre-processing, i.e., by an ADC 148 after passing through an anti-aliasing filter 147, to be used for adaptive selection of the digital LPF 146. Here, the audio amplifier 150 may be a multimedia sound output amplifier of an audio/video/navigation (AVN) system or a separate amplifier for active noise control.

Figure 7:
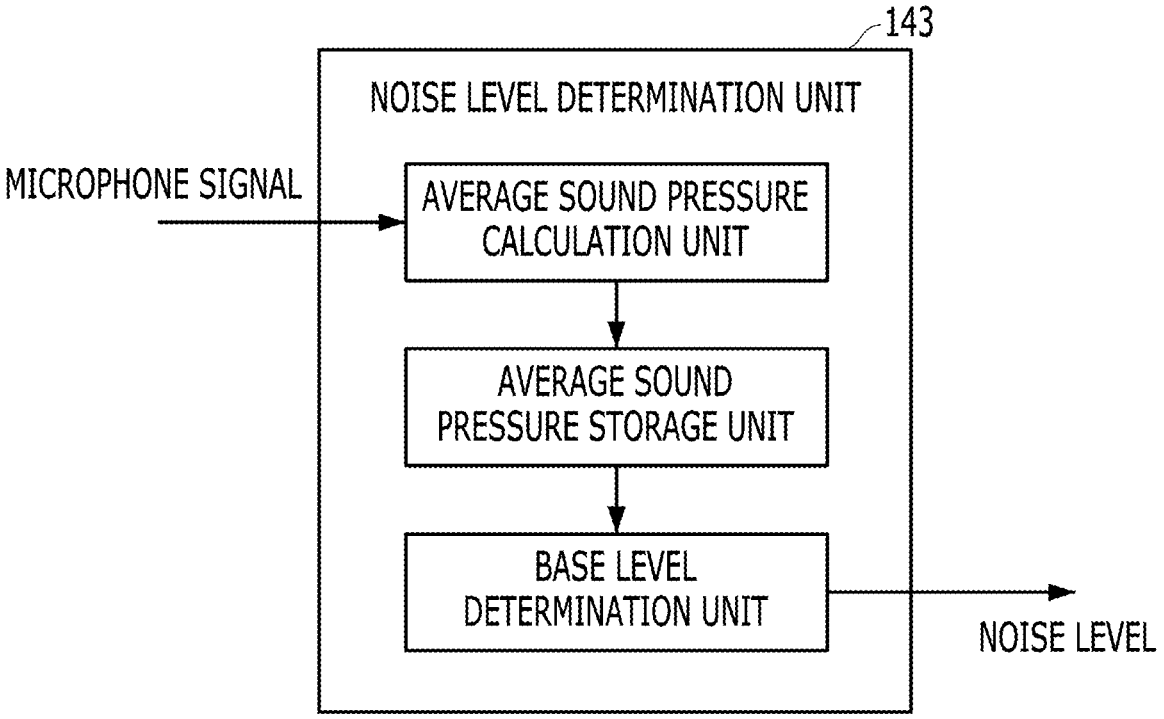
FIG. 7 shows an example of the construction of a noise level determination unit according to various exemplary embodiments of the present invention.

FIG. 7 shows an example of the construction of a noise level determination unit according to various exemplary embodiments of the present invention.

Referring to FIG. 7, the noise level determination unit 143 may include an average sound pressure determination unit, an average sound pressure non-transitory storage unit, and a base level determination unit.

The average sound pressure determination unit determines an average sound pressure at every first period (e.g., every 1 second) based on the pre-processed microphone signal.

The average sound pressure storage unit stores a predetermined integer number N of average sound pressures determined by the average sound pressure determination unit. When the predetermined number N of average sound pressures is stored, the average sound pressure stored first may be discarded. To the present end, the average sound pressure non-transitory storage unit may manage the average sound pressures in a first in first out fashion; however, the present invention is not limited thereto. For example, on the assumption that the first period is 1 second and N is 20, the average sound pressure storage unit may continuously store 1-second-unit average sound pressure information for 20 seconds.

The base level determination unit may arrange a predetermined number of average sound pressures stored in the average sound pressure storage unit at every second period in order of magnitude, and may determine the average of a predetermined bottom range (e.g., bottom 20%) as a base level. It is preferable for the second period to be longer than the first period and to be shorter than the N*first period. The reason for this is that, if the second period is too long, it is difficult to rapidly cope with environmental change, and if the second period is too short, all speaking periods correspond to the second period, whereby a noise level may be set to be too high.

For example, on the assumption that the first period is 1 second, N is 20, and the second period is 5 seconds, the base level determination unit may determine a base level based on average sound pressures determined every 1 second for recent 20 seconds. In the instant case, non-speaking periods may be sufficiently included for a relatively long time of 20 seconds, and the base level may be determined every 5 seconds, which is shorter than the above time, whereby it is possible to faithfully follow environmental change.

The base level determination unit may use a predetermined initial value before determining the base level based on data stored in the average sound pressure storage unit for the first time. The initial value may be a value tuned in advance in a stop state of the vehicle, and the noise level determination unit 143 may add a predetermined value (margin) to the base level to finally determine the noise level.

Meanwhile, in another exemplary embodiment of the present invention, a prediction result of the noise level may be utilized. The construction of an apparatus of the same will be described with reference to FIG. 8.

Figure 8:
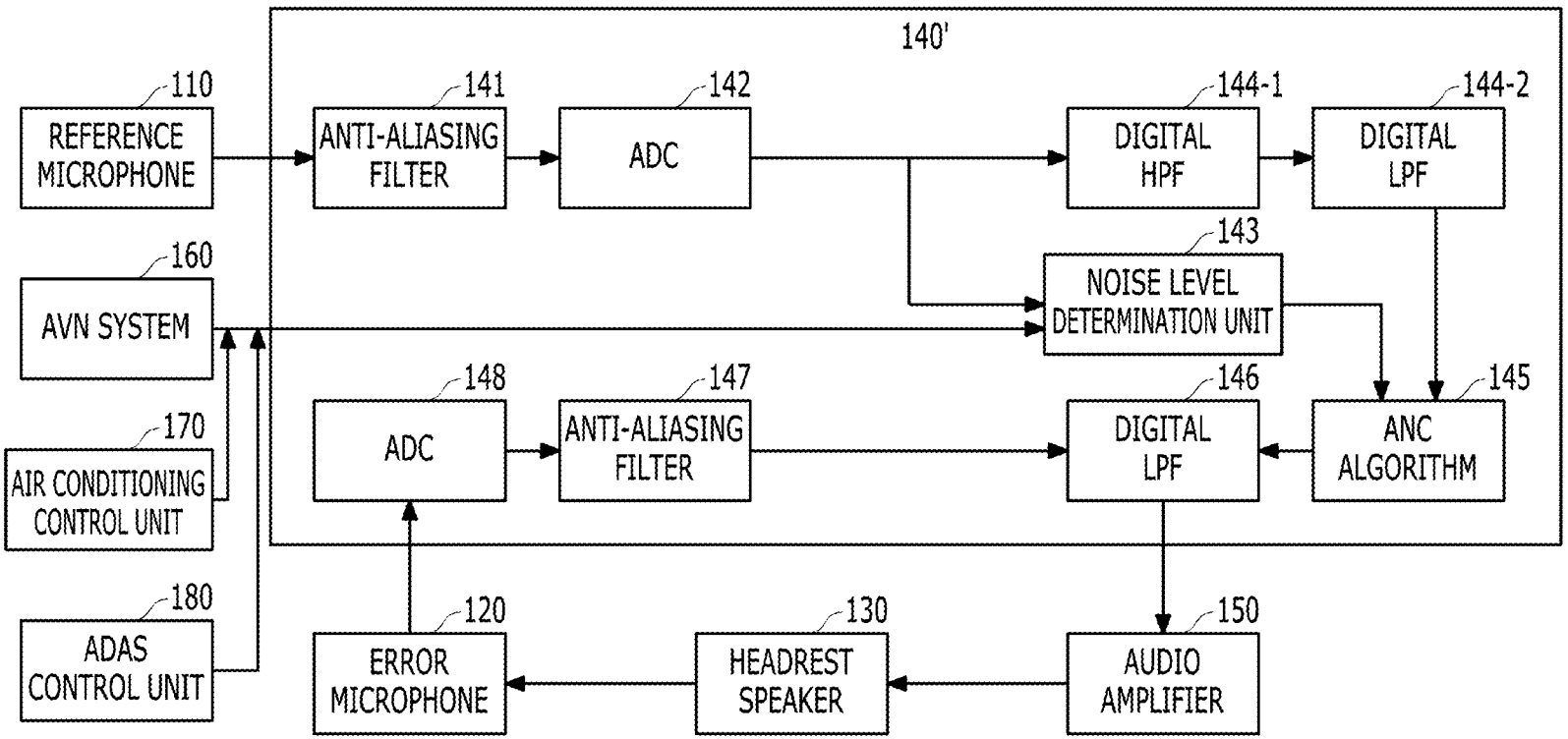
FIG. 8 shows an example of the construction of an active noise control apparatus according to another exemplary embodiment of the present invention.

FIG. 8 shows an example of the construction of an active noise control apparatus according to another exemplary embodiment of the present invention.

The construction of FIG. 8 is identical to the construction of FIG. 6 except that an AVN system 160, an air conditioning control unit 170, and an ADAS control unit 180 are further included and the noise level determination unit 143 of the active noise control unit 140 is changed to a noise level prediction/determination unit 143' of an active noise control unit 140'. Consequently, a description will be given based on the difference in construction between FIGS. 8 and 6.

Referring to FIG. 8, the noise level prediction/determination unit 143' may receive information necessary for noise level prediction from the AVN system 160, the air conditioning control unit 170, and the ADAS control unit 180. For example, the active noise control unit 140' may be provided with a modem that supports a vehicle communication protocol, such as Controller Area Network (CAN), CAN-FD (flexible data-rate), Local Interconnect Network (LIN), or Ethernet, and may receive data from other control units 160, 170, and 180. Consequently, the noise level prediction/determination unit 143' may receive forward road information or traffic situation information from the AVN system, and may receive information related to change in air conditioning state from the air conditioning control unit 170, and may receive information related to change in behavior of the vehicle from the ADAS control unit 180. Of course, such information is illustrated, and the present invention is not limited thereto. For example, although not shown, the noise level prediction/determination unit may receive information related to the state of the window from a body control unit.

The noise level prediction/determination unit 143' may predict change in nearby noise in advance based on the above information, and may variably set a noise level utilizing the prediction information together with accumulated average sound pressure information of the microphone signal. For example, in determining the noise level, when change of information received from the external control units 160, 170, and 180 is within a predetermined range, the noise level prediction/determination unit may set the second period to be longer than a default period, and when change of the received information deviates from the predetermined range, the noise level prediction/determination unit may set the second period to be shorter than the default period. Furthermore, the noise level prediction/determination unit 143' may learn the relationship between the information received from the external control units 160, 170, and 180 and the noise level to determine the noise level.

Operation of the active noise control apparatus according to each of the exemplary embodiments described above will be described with reference to the flowchart of FIG. 9.

Figure 9:
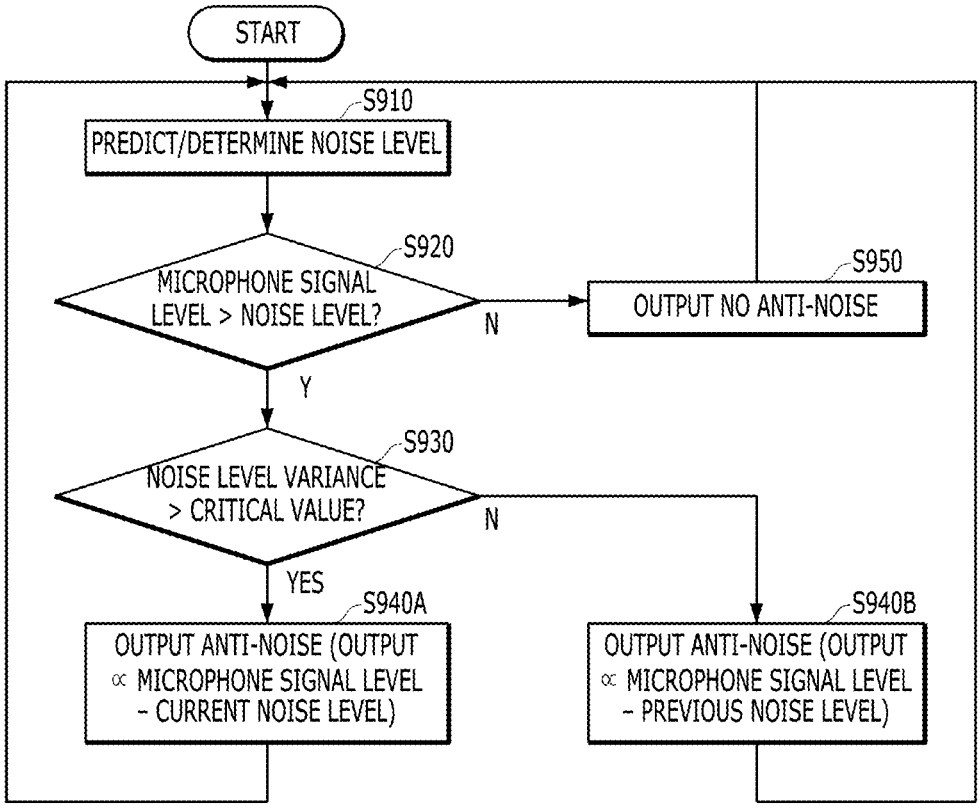
FIG. 9 is a flowchart showing an example of a process of controlling the active noise control apparatus according to each of the embodiments.

FIG. 9 is a flowchart showing an example of a process of controlling the active noise control apparatus according to each of the embodiments.

Referring to FIG. 9, the active noise control unit 140 or 140' may determine a noise level based on a microphone signal or may predict a noise level based on information acquired from the other control units (S910).

The active noise control unit 140 or 140' may determine whether the level of the microphone signal is greater than the predicted or determined noise level (S920). When the level of the microphone signal is greater than the predicted or determined noise level (YES of S920), the active noise control unit is configured to determine variance of the current noise level from a previous noise level (S930). When the variance of the noise level is greater than a predetermined critical value (YES of S930), the active noise control unit 140 or 140' may perform control such that anti-noise is output in proportion to a value obtained by subtracting the current noise level from the level of the microphone signal (S940A). When the variance of the noise level is equal to or less than the critical value (NO of S930), on the other hand, the active noise control unit 140 or 140' may perform control such that anti-noise is output in proportion to a value obtained by subtracting the previous noise level from the level of the microphone signal (S940B). These operations are performed to prevent change in magnitude of anti-noise whenever the noise level is changed.

If the level of the microphone signal is equal to or less than the noise level (NO of S920), no anti-noise may be output (S950).

The present invention described above may be implemented as a computer-readable program stored in a computer-readable recording medium. The computer-readable medium may be any type of recording device in which data is stored in a computer-readable manner. The computer-readable medium may include, for example, a hard disk drive (HDD), a solid-state disk (SSD), a silicon disk drive (SDD), a read-only memory (ROM), a random access memory (RAM), a compact disc read-only memory (CD-ROM), a magnetic tape, a floppy disk, and an optical data storage device.

As is apparent from the above description, an active noise control apparatus of vehicles related to at least various exemplary embodiments of the present invention is configured for achieving privacy protection in a vehicle through more effective voice blocking.

In various exemplary embodiments of the present invention, anti-noise is output only when a passenger speaks in consideration of the magnitude of nearby noise, and the magnitude of the anti-noise is controlled in response to a noise level, whereby it is possible to protect hearing sense of a driver who hears the anti-noise.

It will be appreciated by those skilled in the art that the effects achievable through the present invention are not limited to those that have been particularly described hereinabove and that other effects of the present invention will be more clearly understood from the above detailed description.

Furthermore, the term related to a control device such as "controller", "control unit", "control device" or "control module", etc refers to a hardware device including a memory and a processor configured to execute one or more steps interpreted as an algorithm structure. The memory stores algorithm steps, and the processor executes the algorithm steps to perform one or more processes of a method in accordance with various exemplary embodiments of the present invention. The control device according to exemplary embodiments of the present invention may be implemented through a nonvolatile memory configured to store algorithms for controlling operation of various components of a vehicle or data about software commands for executing the algorithms, and a processor configured to perform operation to be described above using the data stored in the memory. The memory and the processor may be individual chips. Alternatively, the memory and the processor may be integrated in a single chip. The processor may be implemented as one or more processors. The processor may include various logic circuits and operation circuits, may process data according to a program provided from the memory, and may generate a control signal according to the processing result.

The control device may be at least one microprocessor operated by a predetermined program which may include a series of commands for carrying out the method included in the aforementioned various exemplary embodiments of the present invention.

The aforementioned invention can further be embodied as computer readable codes on a computer readable recording medium. The computer readable recording medium is any data storage device that can store data which may be thereafter read by a computer system and store and execute program instructions which may be thereafter read by a computer system. Examples of the computer readable recording medium include hard disk drive (HDD), solid state disk (SSD), silicon disk drive (SDD), read-only memory (ROM), random-access memory (RAM), CD-ROMs, magnetic tapes, floppy discs, optical data storage devices, etc and implementation as carrier waves (e.g., transmission over the Internet). Examples of the program instruction include machine language code such as those generated by a compiler, as well as high-level language code which may be executed by a computer using an interpreter or the like.

In various exemplary embodiments of the present invention, each operation described above may be performed by a control device, and the control device may be configured by a plurality of control devices, or an integrated single control device.

In various exemplary embodiments of the present invention, the control device may be implemented in a form of hardware or software, or may be implemented in a combination of hardware and software.

For convenience in explanation and accurate definition in the appended claims, the terms "upper", "lower", "inner", "outer", "up", "down", "upwards", "downwards", "front", "rear", "back", "inside", "outside", "inwardly", "outwardly", "interior", "exterior", "internal", "external", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. An active noise control method for vehicles, the active noise control method comprising:

primarily determining, by a control unit, a noise level based on a first microphone signal input through a microphone corresponding to a first seat;

secondarily determining, by the control unit, a magnitude of an anti-noise signal generated based on the first microphone signal, based on the determined noise level and a level of the first microphone signal and whether to output the anti-noise signal based on the determined noise level and the level of the first microphone signal; and outputting, by the control unit, the anti-noise signal through a headrest speaker of a second seat in response to the secondary determining, wherein the primary determining includes:

determining an average sound pressure of the first microphone signal at every first period; and determining the noise level at every second period based on N determined average sound pressures recently sequentially stored, wherein the N is an integer number.

2. The active noise control method of claim 1, wherein the first period is shorter than the second period, and wherein the second period is shorter than a product of the first period and the N.

3. The active noise control method of claim 1, wherein the determining the noise level at every second period includes:

determining a base sound pressure corresponding to a predetermined bottom rate based on the N determined average sound pressures; and applying a predetermined margin to the determined base sound pressure to determine the noise level.

4. The active noise control method of claim 1, wherein the primary determining includes:

receiving vehicle operation state information from at least one vehicle control unit; and predicting the noise level based on the received vehicle operation state information.

5. The active noise control method of claim 1, wherein the secondarily determining includes:

determining to output the anti-noise signal upon determining that the level of the first microphone signal is greater than the determined noise level; and determining not to output the anti-noise signal upon determining that the level of the first microphone signal is equal to or less than the determined noise level.

6. The active noise control method of claim 1, wherein the secondarily determining includes controlling the anti-noise signal to be proportional to a value obtained by subtracting the noise level from the level of the first microphone signal upon determining that the level of the first microphone signal is greater than the noise level.

7. The active noise control method of claim 6, wherein the secondarily determining further includes determining variance of the noise level from a previously determined noise level, and wherein the controlling the anti-noise signal includes controlling the anti-noise signal to be proportional to a value obtained by subtracting the previously determined noise level from the level of the first microphone signal upon determining that the variance is equal to or less than a predetermined critical value.

8. The active noise control method of claim 1, further including:

receiving, by the control unit, a second microphone signal through a microphone corresponding to the second seat;

applying, by the control unit, a transfer function corresponding to an acoustic transfer path between the headrest speaker and a predetermined position corresponding to the second seat to the first microphone signal;

generating, by the control unit, error information based on the first microphone signal having the transfer function applied thereto and the second microphone signal; and adaptively selecting, by the control unit, a filter applied to the anti-noise signal based on the error information.

9. A non-transitory computer-readable recording medium including a program for performing the active noise control method of claim 1.

10. An active noise control apparatus of vehicles, the active noise control apparatus comprising:

a microphone corresponding to a first seat;

an active noise control unit configured to generate an anti-noise signal based on a first microphone signal input through the microphone; and a headrest speaker disposed at a second seat, the headrest speaker being configured to output noise corresponding to the anti-noise signal, wherein the active noise control unit is configured to determine a noise level based on the first microphone signal and to determine a magnitude of the output noise, based on the determined noise level and a level of the first microphone signal, and wherein the active noise control unit is configured to determine an average sound pressure of the first microphone signal at every first period and to determine the noise level at every second period based on N determined average sound pressures recently sequentially stored, wherein the N is an integer number.

11. The active noise control apparatus of claim 10, wherein the first period is shorter than the second period, and wherein the second period is shorter than a product of the first period and the N.

12. The active noise control apparatus of claim 10, wherein the active noise control unit is configured to determine a base sound pressure corresponding to a predetermined bottom rate based on the N determined average sound pressures and to apply a predetermined margin to the base sound pressure to determine the noise level.

13. The active noise control apparatus of claim 10, wherein the active noise control unit is configured to receive vehicle operation state information from at least one vehicle control unit and to predict the noise level based on the received vehicle operation state information.

14. The active noise control apparatus of claim 10, wherein the active noise control unit is configured to determine to output the anti-noise signal when the level of the first microphone signal is greater than the noise level and to determine not to output the anti-noise signal upon determining that the level of the first microphone signal is equal to or less than the determined noise level.

15. The active noise control apparatus of claim 10, wherein the active noise control unit is configured to control the anti-noise signal to be proportional to a value obtained by subtracting the noise level from the level of the first microphone signal upon determining that the level of the first microphone signal is greater than the noise level.

16. The active noise control apparatus of claim 15, wherein the active noise control unit is configured to determine variance of the noise level from a previously determined noise level and to control the anti-noise signal to be proportional to a value obtained by subtracting the previously determined noise level from the level of the first microphone signal upon determining that the variance is equal to or less than a predetermined critical value.

17. The active noise control apparatus of claim 10, further including:

a microphone corresponding to the second seat, wherein the active noise control unit is configured to apply a transfer function corresponding to an acoustic transfer path between the headrest speaker and a predetermined position corresponding to the second seat to the first microphone signal, to generate error information based on the first microphone signal having the transfer function applied thereto and a second microphone signal input through the microphone corresponding to the second seat, and to adaptively select a filter applied to the anti-noise signal based on the error information.

* * * * *